US006905166B2

(12) United States Patent
Zhurong et al.

(10) Patent No.: US 6,905,166 B2
(45) Date of Patent: Jun. 14, 2005

(54) PICNIC TABLE

(75) Inventors: Chen Zhurong, Xiamen (CN); Jin Shenghao, Xiamen (CN); Arvin Patel, Sunnyvale, CA (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/668,741

(22) Filed: Sep. 23, 2003

(65) Prior Publication Data

US 2004/0237849 A1 Dec. 2, 2004

(30) Foreign Application Priority Data

Sep. 24, 2002 (CN) ..... 02269592

(51) Int. Cl.[7] ..... A47B 3/14

(52) U.S. Cl. ..... 297/158.4; 297/17; 108/35; 108/132

(58) Field of Search ..... 297/17, 158.4, 297/159.1; 108/35, 36, 38, 132

(56) References Cited

U.S. PATENT DOCUMENTS 1,339,232 A * 5/1920 St John et al. ..... 297/141
1,368,452 A * 2/1921 Puff ..... 108/35
3,574,393 A * 4/1971 Hughes ..... 297/139
4,249,773 A * 2/1981 Giambalvo ..... 297/158.4
4,653,804 A * 3/1987 Yoo et al. ..... 297/158.4
6,109,687 A * 8/2000 Nye et al. ..... 297/158.4
6,347,831 B1 * 2/2002 Nye et al. ..... 297/158.4
6,443,521 B1 * 9/2002 Nye et al. ..... 297/158.4

* cited by examiner

*Primary Examiner*—Peter R. Brown
(74) *Attorney, Agent, or Firm*—Workman Nydegger

(57) ABSTRACT

A folding picnic table includes a foldable table top and two or more seats. The foldable table top is preferably supported by a table top supporting assembly that is movable between an extended position and a collapsible position. Advantageously, the table top supporting assembly can be stored in the foldable table top when the picnic table is in the collapsed position. Desirably, each seat is supported by a seat supporting assembly that is movable between an extended position and a collapsible position. Preferably the seat supporting assembly is stored in a seat when the picnic table is in the collapsed position. The table top supporting assembly can further be folded into a fully folded position when the table top is folded to further reduce the size and dimensions of the picnic table when the picnic table is in the collapsed position.

16 Claims, 10 Drawing Sheets

PICNIC TABLE

CROSS-REFERENCE TO RELATED APPLICATIONS

This application claims priority to Chinese Patent Application No. 02269592.3, filed Sep. 24, 2002, entitled "PICNIC TABLE," which is hereby incorporated by reference in its entirety.

BACKGROUND OF THE INVENTION

1. Field of the Invention

The present invention relates generally to supporting structures. In particular, the present invention relates to picnic tables and, in particular, to foldable or collapsible picnic tables.

2. Description of Related Art

In the past, it has been more difficult for people to get away from their homes and offices. As salaries have increased, so have the nation's living standards. Now, more and more people are able to travel. For example, many people go camping in the countryside to get away from the fast pace of the city and to experience the diversity that nature offers. In the past, when people ate on a trip or camped in the countryside, they usually spread out a blanket or plastic sheet, and sat on the ground. Sometimes, food would be left on the blanket or plastic sheet. This style of eating is both unsanitary and uncomfortable. Most people are accustomed to sitting at a table when eating a meal. Many people, when traveling or camping, desire to be able to eat a meal outside, but do not want the discomfort of having to sit on the ground. According, picnic tables have been developed to provide people with the comforts of home while still being able to enjoy a meal in the outdoors.

Conventional picnic tables, however, are often large and bulky structures that are very difficult to move and transport. Thus, conventional picnic tables must already be present in a location in order to use it.

It is also known to use folding picnic tables to allow people to be able to use picnic tables in any location in which they are able to transport the table. Conventional folding picnic tables often include a table top and two seats located on opposing sides of the table top. The table top may include a recess or storage space formed underneath for storing the two seats when the folding picnic table is collapsed. In addition, a handle may be used to assist a person in transporting the collapsed picnic table.

The table top of conventional folding picnic tables is usually supported by two sets of foldable legs. Generally, the table top includes a frame which is pivotally attached to the two sets of foldable legs. A folding supporting structure usually connects the table top and the foldable legs. The table top may include a recess or storage space formed underneath for storing the two sets of foldable legs when the folding picnic table is collapsed. The seats of a conventional folding picnic table are usually supported by a foldable seat supporting assembly. The seats may include a recess or storage space for storing the seat supporting assembly when it is collapsed.

When conventional folding picnic tables are folded into a collapsed or storage position, the foldable legs are folded toward the seats. The legs are pivotally connected to the seat so that the legs can be housed within the storage area of the seat. The seats are then placed into the storage area of the table top. The legs and/or seat may be fastened to the table top to prevent the legs or seat from accidentally unfolding.

Disadvantageously, because this type of conventional folding picnic table is only able to collapse the seat and the legs, the resulting structure may still be rather large because the surface area of the table top is comparatively large. Thus, even in the collapsed or storage position, conventional folding picnic tables may be large, bulky and difficult to move.

Furthermore, there is often a limited amount of space in a persons' house or property where a folding picnic table can be stored. Often, a person must store the table upright against a wall, which may inadvertently fall or tip over. If the folded picnic table is stored horizontally, the folded picnic table disadvantageously requires a large amount of space.

In addition, a conventional folding picnic table is generally unwieldy for a single person to transport, even in its folded state. Transporting a large folding picnic table can sometimes be dangerous if the person is too small to lift the table by oneself. Additionally, when a conventional folding picnic table is in the folded or collapsed position, the folded legs structures are often exposed or extend outwardly from the table top. The outwardly extending legs may catch on other objects or cause potential injury to a person who may come in contact with the exposed structures.

BRIEF SUMMARY OF THE INVENTION

A need therefore exists for a picnic table that eliminates the above-described disadvantages and problems.

One aspect of the invention is a picnic table with a folding table top. Advantageously, the picnic table with the folding table top greatly reduces the size and dimensions of the picnic table in the folded or collapsed position.

Another aspect is a folding picnic table including a table top, a table top supporting assembly, a pair of seats, and a seat supporting assembly corresponding to each seat. The table top and seats preferably have storage areas formed on a bottom region thereof for housing the table top supporting assembly and/or seat supporting assembly when said supporting assembly is collapsed. The storage area of the table top may also be configured to house the seats. In addition, the table top may be configured to fold in half to encompass the table top supporting assembly, seats, and seat supporting assembly.

Yet another aspect is a table top supporting assembly that is pivotably connected to the table top so that it can be positioned between an extended position and a collapsed position. In addition, the table top supporting assembly may have pivoting or hinged regions that allow the table top supporting assembly to further fold in half. For example, the table top supporting assembly may include a cross bar that is disposed at each end of the table top with one end of the cross bar connected to a first planar portion of the table top and the second end of the cross bar being connected to the second planar portion of the table top. The table top may also include connection apertures through which ends of the cross bar may be disposed and a pair of leg members may be attached to the first cross bar. The opposing ends of the leg members are preferably attached to a second cross bar. Further, the first cross bar may include two portions that are connected at a pivot connection and the second cross bar may include two portions that are connected at a hinge assembly. Other hinge assemblies may be provided between the first planar portion and the second planar portion to facilitate folding of the table top.

Another aspect is one or more leg members that are selectively adjustable so that a person is able to shorten or lengthen the length of the leg members. For example, the leg members include an inner portion and an outer portion which are slidably connected or engaged. A locking mechanism may be provided to lock the legs in a desired position. The locking mechanism, for example, may include a spring switch.

Yet another aspect is a folding picnic table including a table top with a top surface and a bottom surface extending between a first end and a second end, the table top being divided into a first planar portion and a second planar portion, the table top configured to be selectively foldable, wherein the first planar portion and the second planar portion have a storage area formed in the bottom surface thereof. The table top supporting assembly may include a first cross bar having a first end and a second end, the first end being connected to the first planar portion and the second end being connected to the second planar portion, wherein the first cross bar has a pivot connection disposed along the length thereof for allowing the first cross bar to fold; a first leg member having a first end and a second end, the first end being connected to the first cross bar; a second leg member having a first end and a second end, the first end being connected to the first cross bar; a seat having a top surface and a bottom surface extending between a first end and a second end, seat having a storage area formed in the bottom surface thereof; and a seat supporting assembly including a first leg assembly pivotably connected to the seat; and a second leg assembly pivotably connected to the seat.

The folding picnic table may include the pivot connection having a first hinge connector having a C-shaped body and having pin hole formed at an end thereof; a second hinge connector having a C-shaped body and having a pin hole formed at an end thereof; and a pin disposed through the pin holes on the first and the second hinge connectors.

The folding picnic table may include a second cross bar being connected to the second end of the first leg member and the second end of the second leg member, the second cross bar having a hinge assembly disposed along the length thereof for allowing the second cross bar to fold.

The folding picnic table may include the hinge assembly having a first hinge connector having a first end connected to the first planar portion and a second end included a pin hole, the first hinge connector including a cam portion on the second end; a second hinge connector having a first end connected to the second planar portion and a second end including a pin hole, the second hinge connector including a locking slot; a hinge pin disposed in the pin hole of the first and second hinge connectors, the longitudinal axis of the hinge pin forming a hinge axis, wherein the table top is configured to fold about the hinge axis; a locking pin adapted to be disposed in the locking slot of the second hinge connector, the locking pin being selectively moveable within the locking slot between a locked position wherein the locking pin is positioned so that the cam portion of the first hinge connector abuts the locking pin so as to substantially prevent the first hinge connector from rotatable movement about the hinge axis, and an unlocked position wherein the first hinge connector is able to freely rotate about the hinge axis.

The folding picnic table may include a lock actuating mechanism pivotally disposed about the hinge pin, the lock actuating mechanism having a handle portion; and a displacement slot disposed at an offset angle with respect to the locking slot and configured to receive the locking pin so that when the handle is moved between a first position to a second position, the offset angle of the displacement slot acts to slide the locking pin in the locking slot between the locked and the unlocked position.

The folding picnic table may include the lock actuating mechanism further having a locking bar disposed in the second hinge connector; and an anchoring portion configured to maintain the handle in the first and second positions, the anchoring portion including an elongate member having a first groove and a second groove, wherein in the first position, the first groove is configured to engage a portion of the locking bar and in the second position, the second groove is configured to engage a portion of the locking bar.

The folding picnic table may include the first planar portion and the second planar portion having facing connecting apertures, each connecting aperture configured to receive one of the first end and the second end of the cross bar.

The folding picnic table may include the first leg member and the second leg member each having an inner portion; an outer portion, wherein the inner portion and the outer portion slidably engage; and a locking mechanism for selectively positioning the inner portion and the outer portion at various lengths.

The folding picnic table may include the locking mechanism having a spring switch located on one of the inner portion and the outer portion; and a positioning hole located on the other of the inner portion and the outer portion, the positioning hole configured to receive the spring switch.

The folding picnic table may include a depression lever for activating the spring switch.

The folding picnic table may include a first pivotable support bar having a first end and a second end, the first end being connected to the first leg member and the second end being connected to the first planar portion; and a second pivotable support bar having a first end and a second end, the first end being connected to the second leg member and the second end being connected to the second planar portion.

The folding picnic table may include the table top supporting assembly having a second cross bar having a first end and a second end, the first end being connected to the first planar portion and the second end being connected to the second planar portion, wherein the second cross bar has a pivot connection disposed along the length thereof for allowing the second cross bar to fold; a third leg member having a first end and a second end, the first end being connected to the second cross bar; and a fourth leg member having a first end and a second end, the first end being connected to the second cross bar.

The folding picnic table may include a first side rail having a first end and a second end, the first end of the first side rail being connected to the first cross bar and the second end of the first side rail being connected to the second cross bar; and a second side rail having a first end and a second end, the first end of the second side rail being connected to the first cross bar and the second end of the second side rail being connected to the second cross bar.

The folding picnic table may include a hinge assembly disposed between the first planar portion and the second planar portion.

The folding picnic table may include each of the first planar portion and the second planar portion having a handle formed thereon, the handles configured to align when the table top is folded to provide a carrying mechanism.

The folding picnic table may include mortise and tenon members formed on the first and second planar portions.

Advantageously, by dividing the folding table top of a folding picnic table into two small table tops, and by setting a storage space for the releasable seat tops in the recesses underneath the small table tops, the seats can be easily stored. In addition, the folding of the side rails passing through the pivots and the rotation of the pivots at the connection between the small table tops as well as the release of the action trigger mechanism passing through the cross bars of the table legs, the folding of the two small table tops is realized and the collapsed size of the picnic table is greatly reduced. Further, when the picnic table is in the open position, the locking of the action trigger mechanism and the connection and pivots of the front and back side rails, the table is preferably locked into position and it cannot rotate because the rotation direction of the side rails makes the folding-up direction of the side rails different from the folding-up direction of the small table tops. Finally, adding the coordination of the support bars, creates a folding table with stability when opened. Advantageously, when the folding table and seats are in the collapsed position, the size and dimensions of the picnic table are greatly reduced. This makes storage, moving and transportation of the picnic table much easier.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

Figure 9:
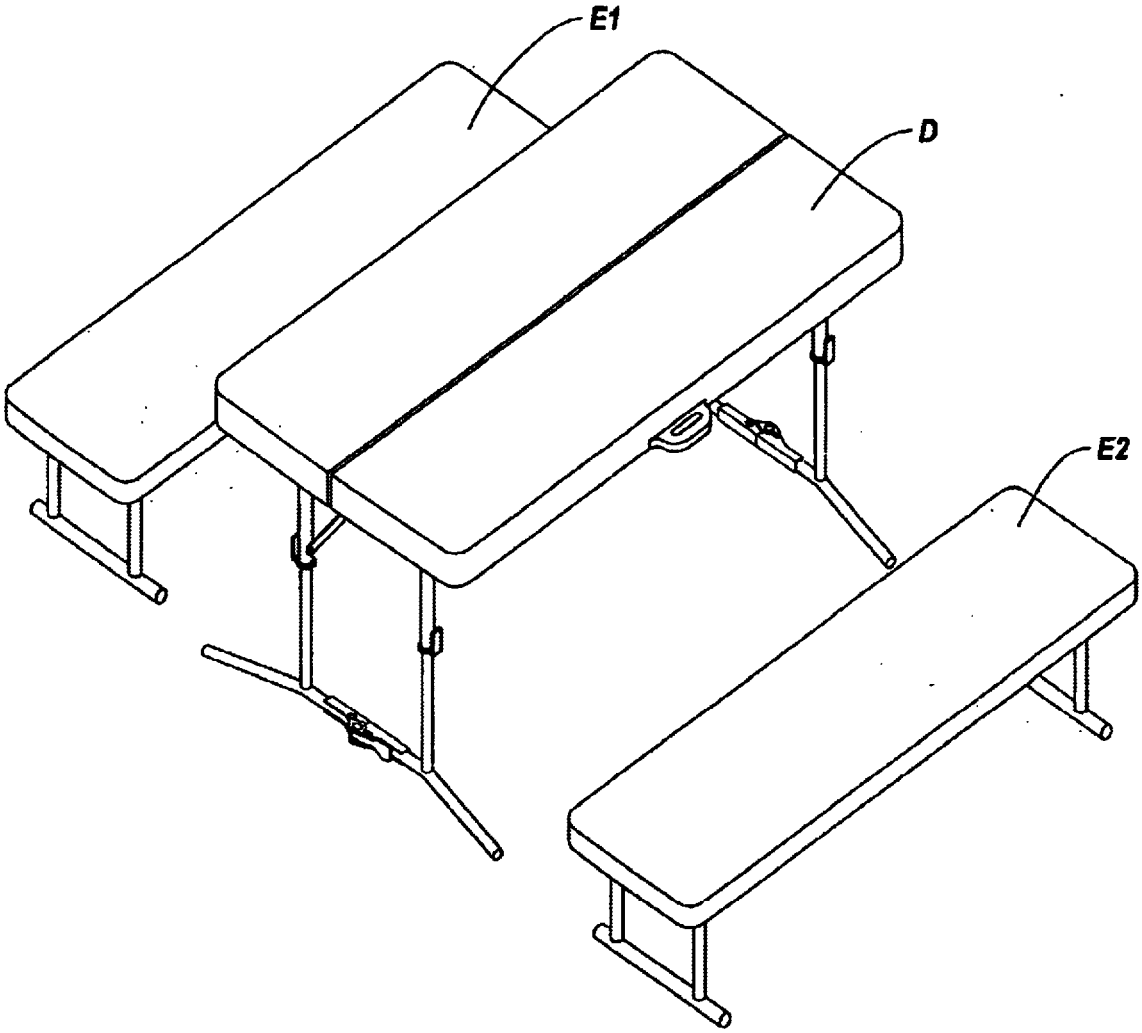
FIG. 9 is a perspective view of another preferred embodiment of a folding picnic table.

The present invention is related to folding picnic tables which are able to be compactly folded. An exemplary folding table is shown in FIG. 9 in the unfolded position. The folding table includes a table top D and two seats E1, E2. The folding table also includes a table top supporting assembly and two seat supporting assemblies.

It will be appreciated that one half of the folding table is a mirror image of the other half. As such, only the description of one of seats E1 and the accompanying seat supporting assembly will be provided with the understanding that the other seat and seat supporting assembly operates in substantially the same manner.

Figure 7:
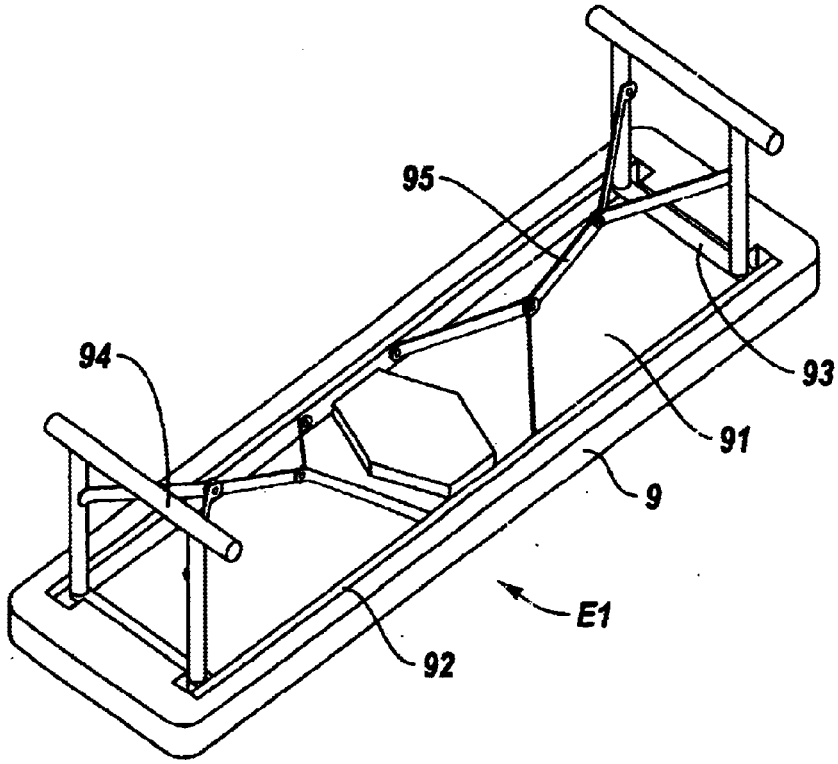
FIG. 7 is a perspective view of a seat for a folding picnic table, illustrating the seat supporting assembly in the fully extended position.
Figure 8:
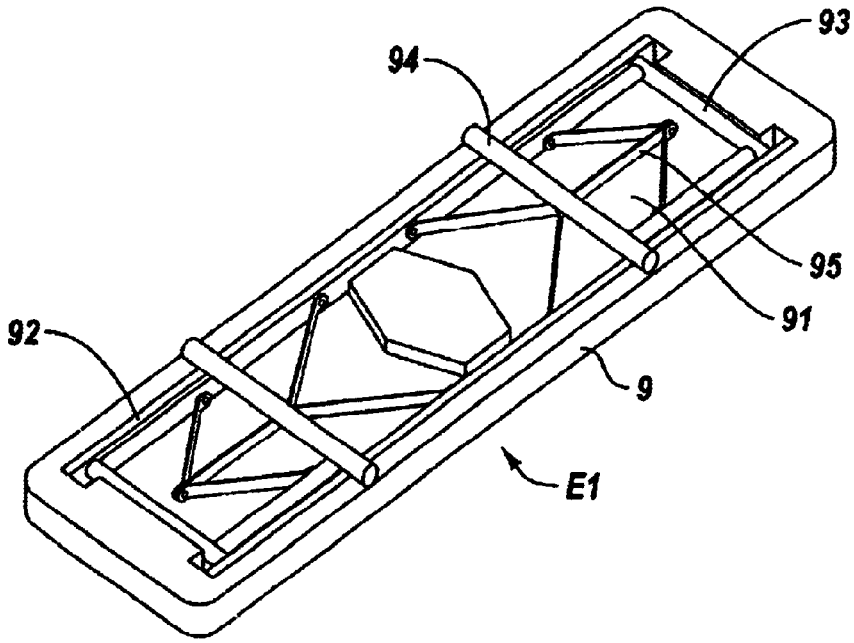
FIG. 8 is a perspective view of a seat for a folding picnic table, illustrating the seat supporting assembly in the collapsed position.

With reference to FIGS. 7 and 8, seat E1 is shown in greater detail. Seat E1 includes a seat top 9 and a storage area 91 for storing the seat supporting assembly therein. The seat supporting assembly includes a pair of spaced apart side rails 92 disposed on the underside of seat top 9. A pair of end rails 93 are pivotally attached to each end of each side rail 92. End rail 93 is connected to a seat leg 94. One end of a support bar 95 is V-shaped and pivotally connected to both leg members of the seat leg 94. The other end of the support bar 95 is also V-shaped and pivotally connected to a central area of opposing side rails 92. The seat support assembly is thus selectively positioned between a fully extended position (FIG. 7) and a folded position (FIG. 8).

Figure 1:
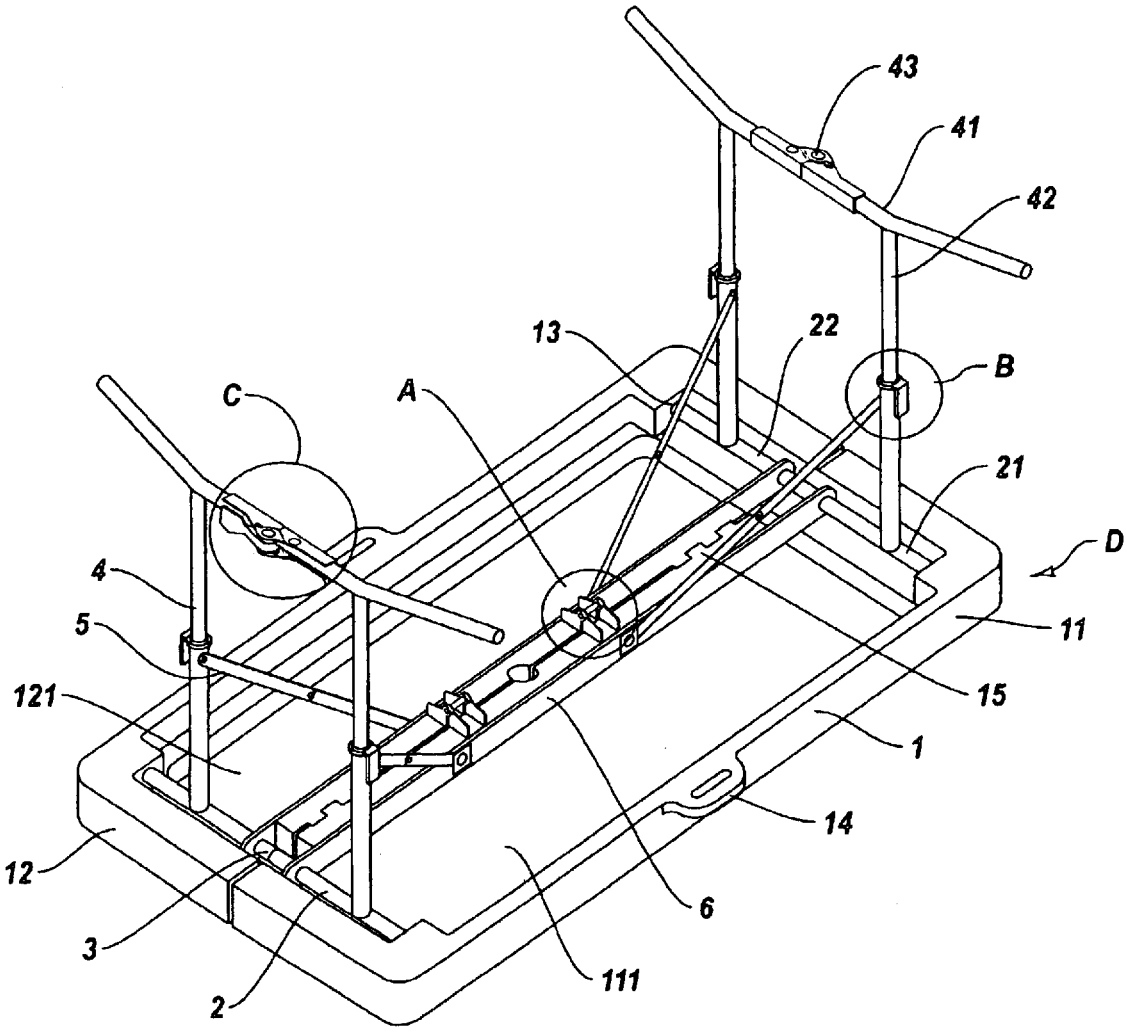
FIG. 1 is a perspective view of the table top of the folding picnic table in accordance with a preferred embodiment of the present invention, illustrating the table top supporting assembly in the fully extended position.
Figure 2:
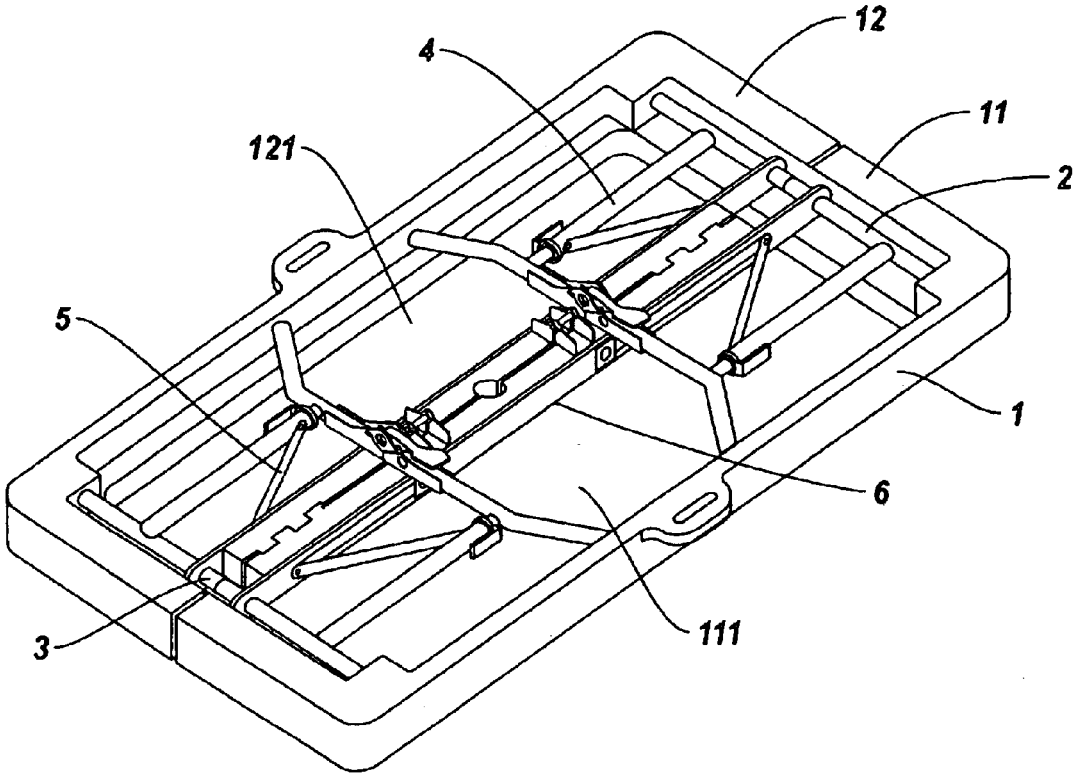
FIG. 2 is a perspective view of the table top of the folding picnic, illustrating the table top supporting assembly in the collapsed position.
Figure 12:
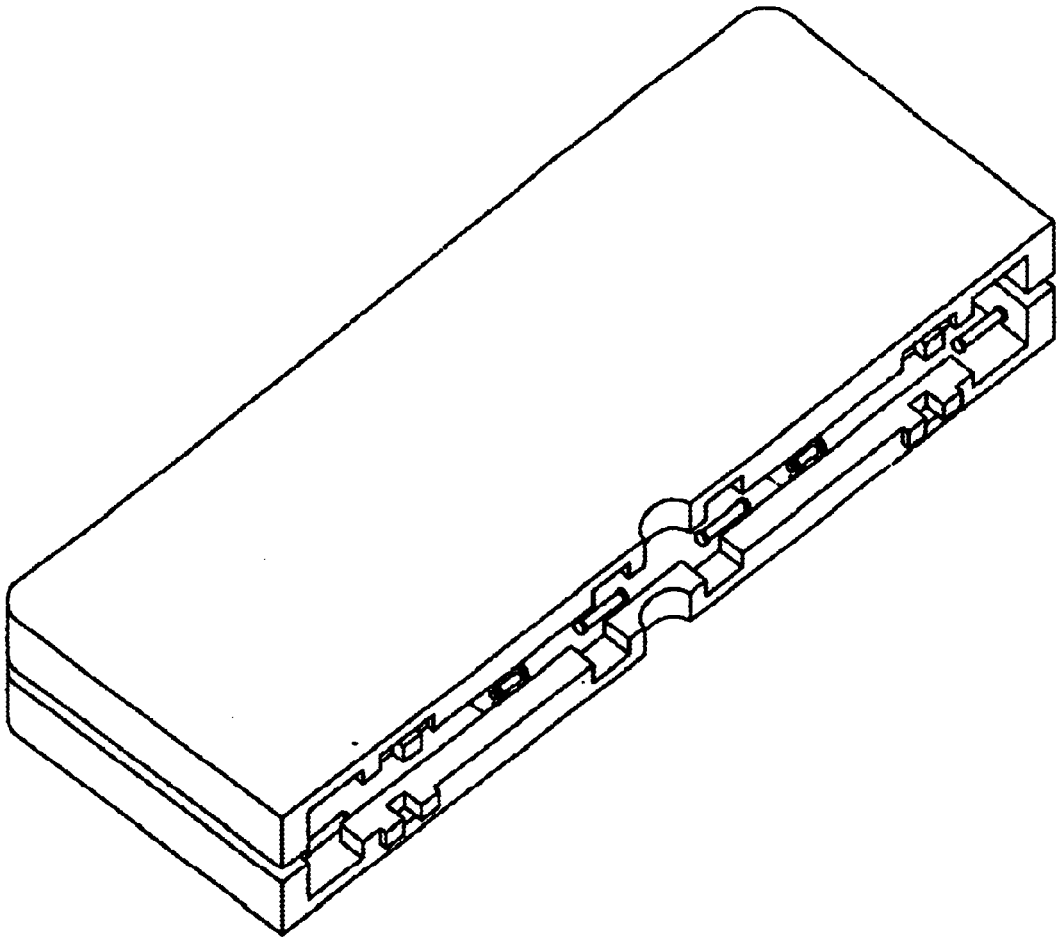
FIG. 12 is a perspective view of yet another preferred embodiment of a folding picnic, illustrating the folding picnic table in a folded position.

With reference to FIGS. 1 and 2, foldable table top D is shown in further detail. Table top D includes a planar structure 1 comprising a first portion 11 and a second portion 12. Table top D is thus selectively positionable between a fully extended position (FIG. 1) and a folded position (FIG. 12). Handles 14 are disposed on the outside periphery of table top D to assist in transporting the table when fully folded. Mortise and tenon hinges 15 are disposed along the interface between first and second portions 11, 12 of table top D.

First and second portions 11, 12 include storage spaces 111, 121 formed on the undersides thereof. Storage spaces 111, 121 are configured to house seats E1, E2 and seat support assemblies. In addition, the storage spaces 111, 121 are configured to house the table top support assembly. As such, the storage spaces 111, 121 have a two-tiered arrangement in which a ledge is formed on each side of the seats E1, E2 to distinguish the two levels. The portion of storage spaces 111, 121 nearest the top surface of table top D is configured to store the seats E1, E2 and seat support assemblies while the portion nearest the bottom surface of the table top D is configured to store the table support assembly. Four corners project from each corner of the storage space 111, 121. The corners assist to connect portions of the table support assembly to table top D. At one end of the table top D, connecting apertures 13 are formed in sides of corners facing each other.

As shown in FIG. 1, the table support assembly includes a pair of table legs 4 connected to the table top D by a cross pole 2. The table leg 4 includes two leg members 42 connected by a cross bar 41. Each of the ends of the two leg members 42 are connected to the cross pole 2. The table top support assembly further includes two side rails 6 disposed at a central portion of table top D. Each side rail 6 connects opposing cross poles 2. A pivotable support bar 5 is connected between a side rail 6 and a leg member 42 on the same side. The table top support assembly is thus positionable between a fully extended position (FIG. 1), a collapsed position (FIG. 2), and a fully folded position (FIG. 12).

As shown in FIG. 1, the ends of cross pole 2 are disposed in a pair of facing connecting apertures 13 at one end of table top D. The cross pole 2 is formed from a first portion 21 and a second portion 22 which are pivotably connected by a pivot connection 3.

Figure 3:
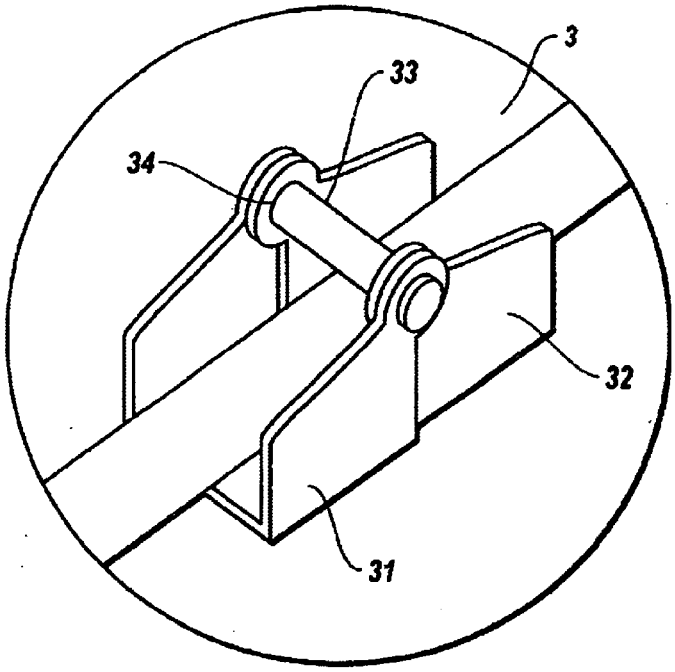
FIG. 3 is a partial perspective of a portion of the folding picnic table shown in FIG. 1 and identified as part A.

As shown in FIG. 3, the pivot connection 3 includes first and second hinge connectors 31, 32. The hinge connectors 31, 32 are C-shaped or U-shaped members having a bottom wall and two side walls extending therefrom. Each hinge connector 31, 32 includes a connector portion having a pin hole 34. The pin holes 34 of each hinge connector 31, 32 are aligned so that a pin 33 may be disposed therethrough. Each hinge connector 31, 32 is connected to one of the ends of the first or second portion 21, 22 of cross pole 2. The bottom surfaces of the hinge connectors 31, 32 are disposed against the bottom surface of the table top D so that the side walls extend outwardly from the table top D. Thus, the cross pole 2 is able to pivot in one direction to selectively position the cross pole 2 between a fully extended position (FIG. 1) and a folded position (FIG. 12). Because cross pole 2 is connected to first and second portions 11, 12 of table top D via connecting apertures 13, folding of the cross pole 2 can be carried out by folding the table top D.

Figure 4:
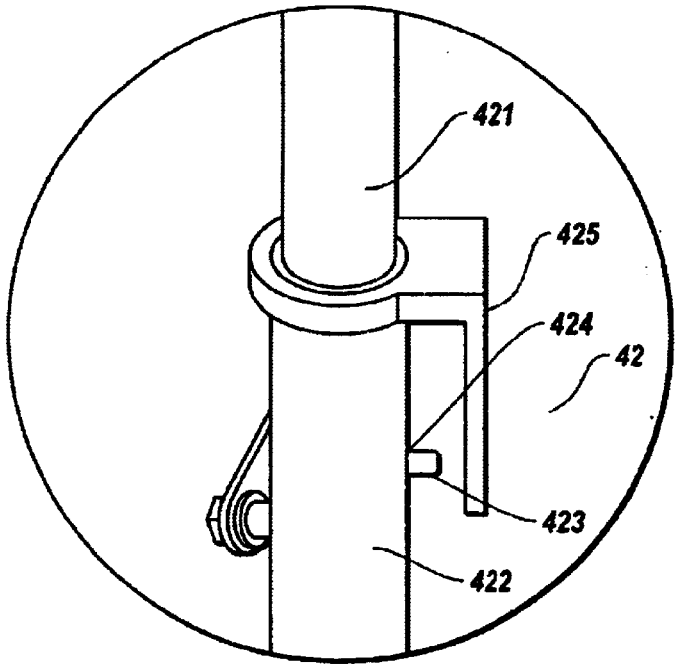
FIG. 4 is a partial perspective of a portion of the folding picnic table shown in FIG. 1 and identified as part B.
Figure 5:
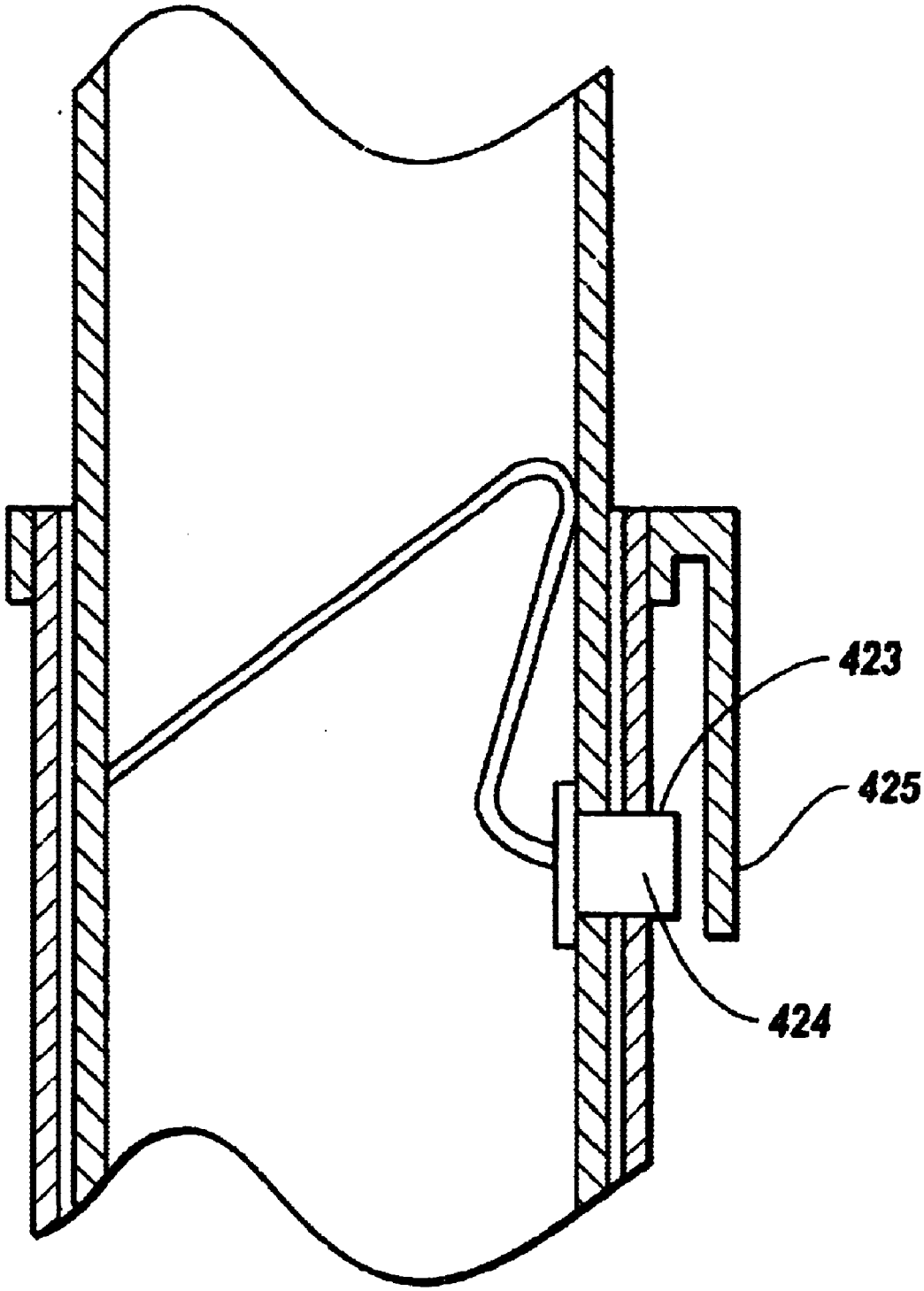
FIG. 5 is cross sectional view of the portion of the folding picnic table shown in FIG. 4.

As shown in FIG. 1, each table leg 4 includes two leg members 42 connected by a cross bar 41. With further reference to FIG. 4, each leg member 42 includes an inner and outer portion 421, 422 which are slidably engaged so that the leg members 42 can be selectively positioned at various lengths. A spring switch 423 maintains the inner and outer portion 421, 422 at the desired position. The spring switch 423 is located at the bottom of the inner portion 421, and a positioning hole 424 for receiving spring switch 423 is located at the top of the outer portion 422. It will be appreciated that one or more positioning holes 424 may be formed in outer portion 422 along varying lengths to allow the table leg 4 to be positioned at varying lengths. A lever 425 for depressing spring switch 423 is located at the top of the outer portion 422 such that the lever is disposed over the positioning hole 424.

Figure 6:
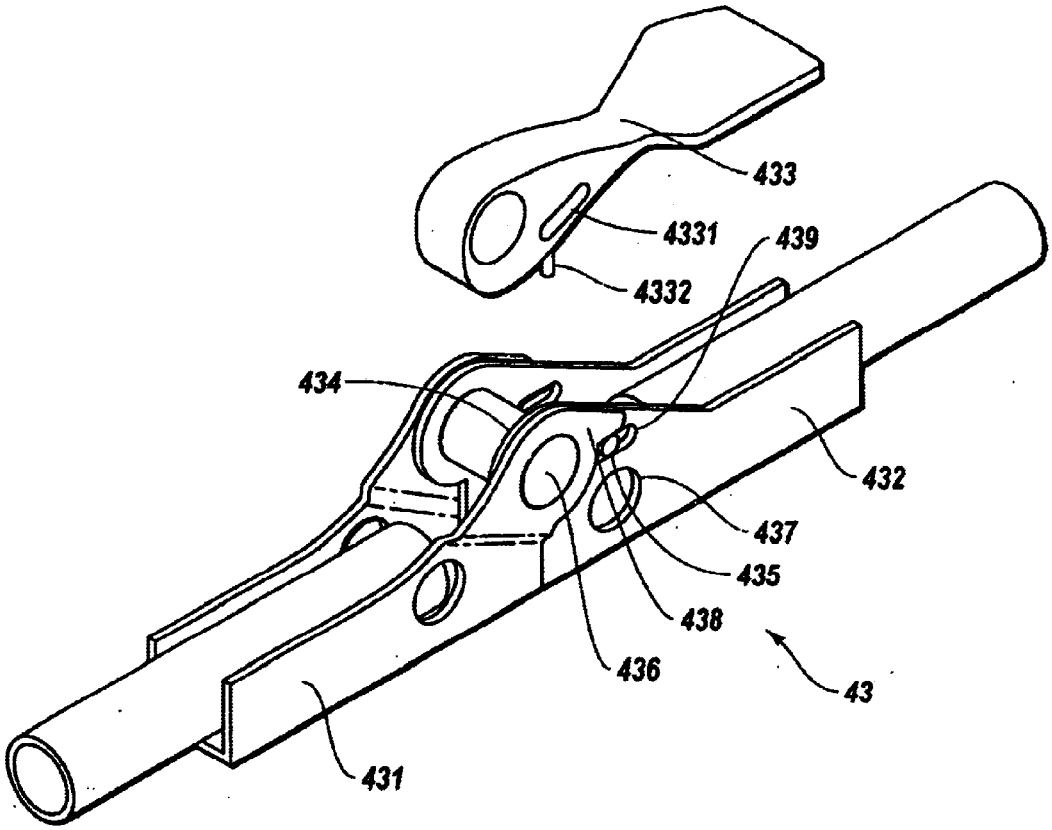
FIG. 6 is a partial perspective of a portion of the folding picnic table shown in FIG. 1 and identified as part C.

The cross bar 41 is divided into two portions similar to cross pole 2. A hinge assembly 43 provides two functions. First, it allows the two portions of cross bar 41 to fold. Second, it provides a locking mechanism so that in the unfolded position, the cross bar 41 remains in the extended position. As shown in FIG. 6, the hinge assembly comprises first and second hinge connectors 431 and 432 in pivotal engagement. The hinge assembly also includes a lever 433 which is pivotally disposed in relation to the first and second hinge connectors 431, 432 about a rotation axis 434.

The hinge connectors 431 and 432 each have a connector portion having formed therein a pair of connecting apertures 436. The connecting apertures 436 of each hinge connector 431, 432 are aligned (optionally with the lever 433) so that a pin can be disposed therethrough to form a pivotal connection. First hinge connector 431 includes a cam portion 438. The second hinge connector 432 includes a slot 439 for receiving a locking pin 435. In addition, the second hinge connector 432 also includes a locking bar 437. Thus, slot 439 for receiving locking pin 435 is set between the connecting aperture 436 and the locking bar 437. Because locking slot 439 is elongated, locking pin 435 is able to slide within locking slot 439. Locking pin 435 and locking slot 439 cooperate with cam portion 438 of the first hinge connector 431 to form the locking mechanism.

Lever 433 also includes an elongated displacement slot 4331 for receiving locking pin 435. Lever 433 also includes an anchoring portion 4332 which is able to abut against the locking bar 437 in two positions. That is, anchoring portion 4332 includes two curve-shaped positioning grooves which are configured to receive the outside surface of the locking bar 437.

During assembly, first hinge connector 431, second hinge connector 431 and lever 433 are aligned so that they are disposed about and pivotable about rotation axis 434. The locking pin 435 is disposed through slot 439 of the second hinge connector 432 and the displacement slot of the lever 433. One of the grooves of the anchoring portion 4332 abuts the locking bar 437. In addition, each of the first and second hinge connectors 431, 432 are connected to one end of the portions of the cross bar 41. More details of the hinge assembly may be found in U.S. patent application Ser. No. 10/616,800, filed Jul. 10, 2003, entitled "A FOLDING TABLE," which application is incorporated herein by reference in its entirety.

Figure 11:
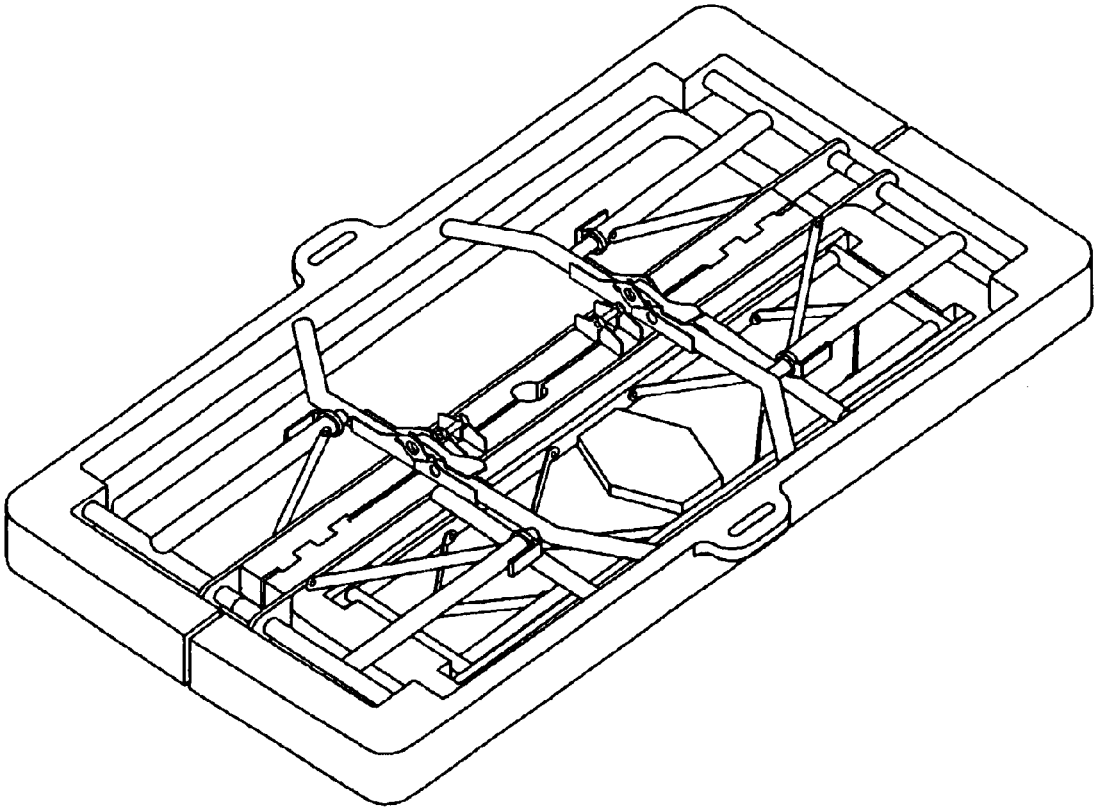
FIG. 11 is perspective view of a preferred embodiment of a folding picnic table, illustrating a seat stored in the table top and the table top supporting assembly in a collapsed position.

The operation of the folding picnic table will now be discussed. To open the folding picnic table from a fully folded position (FIG. 12), the first and second portions 11, 12 of table top D are unfolded (as shown in FIG. 11). The mortise and tenons 15 located on first and second portion 11, 12 are matched up to come in contact with each other.

Figure 10:
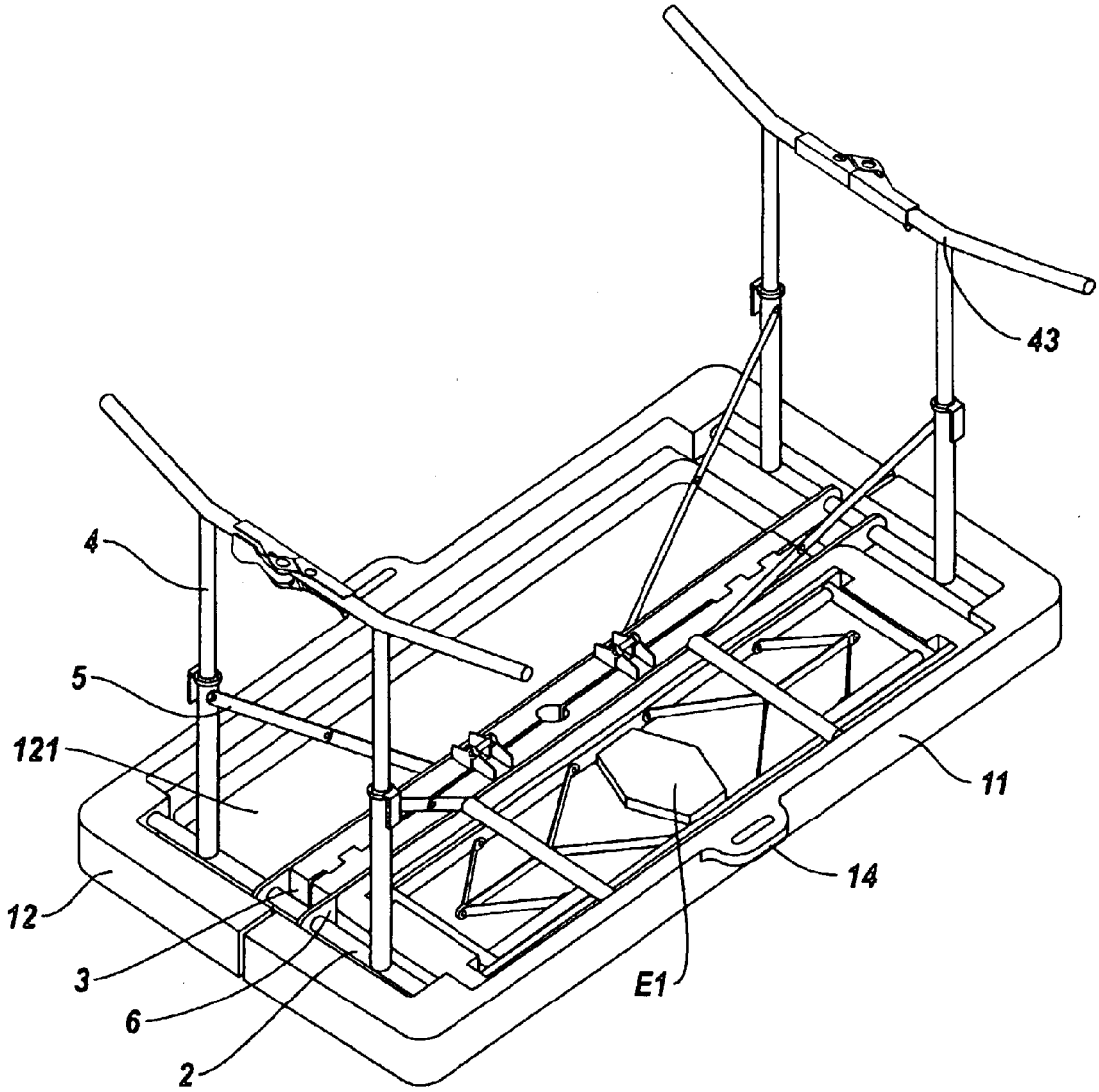
FIG. 10 is a perspective view of a preferred embodiment of a folding picnic table, illustrating a seat stored in the table top.

The act of unfolding table top D will also unfold portions 21, 22 of cross poles 2 at pivot connection 3 and the portions of cross bar 41 at the hinge assembly located thereon. The hinge assembly on cross bar 41 is operated to maintain the cross bar 41 in the unfolded position. That is, the lever 433 is operated to place locking pin 435 in slot 439 in the locked position. One of the grooves of anchoring portion 4332 on the lever 433 contacts locking bar 437. The cam portion 348 of the first hinge connector 431 is restricted by the locking pin 435 so that the first hinge connector 431 and the second hinge connector 432 are in a locked state and cannot be rotated relative to each other. Thus, cross bar 41 is maintained in a straight line (as shown in FIG. 10). The table legs 4 are then unfolded to a 90 degree angle with respect to table top D. Raising table legs 4 to the extended position also unfolds support bars 5.

Seats E1 and E2 are removed from the storage areas 111 and 121 in the first and second portions 11, 12 of table top D. The seat supporting assemblies are then unfolded from the collapsed position (FIG. 8) to the extended position (FIG. 7) so that the seat top 9 rests on the extended seat legs 94.

The table legs 4 connected to table top D can be lengthened by pulling the crossbar 43 upward, making the inner and outer portions 421 and 422 slide away from each other. When the inner portion 423 is pulled up to a certain position, the spring switch 423 located in the inner portion 421 and the positioning hole 424 of the outer portion 422 will match up, fixedly positioning the inner and outer portions 421 and 422 so that they are unable to move in relation to each other. The table top D and seats E1, E2 are then turned right side up so that the folding picnic table is ready for use as shown in FIG. 9.

When desired to fold the foldable picnic table, the steps are reversed. First, the table top D and seats E1 and E2 are turned upside down. The seat support assemblies are folded into the collapsed position (FIG. 7) so that they are stored in storage area 91 in seats E1, E2. Preferably, the seat support assemblies are able to fit within the boundary of seats E1, E2. Seats E1, E2 (having the seat assemblies stored therein) are placed within the storage compartments 111 and 121, respectively, of the first and second portions 11, 12 of table top D. Preferably, the seats E1, E2 are able to fit within the boundary of portions 11, 12 of table top D.

The table legs 4 are retracted or shortened by depressing the lever 425 of the spring switch 423 which releases the spring switch 423 of the inner portion 421 from the positioning hole 424 of the outer portion 422. The inner portion 421 is able to then slide relative to the outer portion 422 so that pressing the cross bar 41 or other part of table legs 4 downward retracts the inner and outer portions 421, 422. Table legs 4 only have to be shortened enough so that they do not overlap when folded onto the table top D. The table legs 4 and support bars 5 are then folded from the extended state (FIG. 10) to the collapsed state (FIG. 11). Preferably, the table top supporting assembly is able to fit within the boundary of table top D.

The hinge assembly is unlocked by rotating lever 433 which slides the locking pin 435 to the opposing end of slot 439 so that locking pin 435 is not abutted by cam portion 348. In addition, anchoring portion 4332 of lever 433 is repositioned to unengaged one of the grooves with locking bar 437 and engage the other groove with locking bar 437 so that locking pin 435 is fixed in place. The cam portion 348 of first hinge connector 431 releases the locking pin 435 from the locked position the first hinge connector 431 and the second hinge connector 432 are in an unlocked state and can rotate in relation to each other. With the hinge assembly unlocked, the cross bar 41 is able to fold.

Finally, table top D is then folded. By folding table top D, table legs 4 are also folded to the folded state (FIG. 12) at cross poles 4 and cross bars 41. Folding table top D essentially forms a box bounded by first and second portions 11, 12. Handles 14 preferably aligned to make a useful carrying mechanism.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A folding picnic table comprising:

a table top having a top surface and a bottom surface extending between a first end and a second end, the table top being divided into a first planar portion and a second planar portion, the table top configured to be selectively foldable, wherein the first planar portion and the second planar portion have a storage area formed in the bottom surface thereof;

a table top supporting assembly comprising:

a first cross bar having a first end and a second end, the first end being connected to the first planar portion and the second end being connected to the second planar portion, wherein the first cross bar has a pivot connection disposed along the length thereof for allowing the first cross bar to fold;

a first leg member having a first end and a second end, the first end being connected to the first cross bar;

a second leg member having a first end and a second end, the first end being connected to the first cross bar;

a seat having a top surface and a bottom surface extending between a first end and a second end, seat having a storage area formed in the bottom surface thereof; and a seat supporting assembly comprising:

a first leg assembly pivotably connected to the seat; and a second leg assembly pivotably connected to the seat.

2. The folding picnic table as recited in claim 1, wherein the pivot connection comprises:

a first hinge connector having a C-shaped body and having pin hole formed at an end thereof;

a second hinge connector having a C-shaped body and having a pin hole formed at an end thereof; and a pin disposed through the pin holes on the first and the second hinge connectors.

3. The folding picnic table as recited in claim 1, further comprising a second cross bar being connected to the second end of the first leg member and the second end of the second leg member, the second cross bar having a hinge assembly disposed along the length thereof for allowing the second cross bar to fold.

4. The folding picnic table as recited in claim 3, wherein the hinge assembly comprises:

a first hinge connector having a first end connected to the first planar portion and a second end including a pin hole, the first hinge connector including a cam portion on the second end;

a second hinge connector having a first end connected to the second planar portion and a second end including a pin hole, the second hinge connector including a locking slot;

a hinge pin disposed in the pin hole of the first and second hinge connectors, the longitudinal axis of the hinge pin forming a hinge axis, wherein the table top is configured to fold about the hinge axis;

a locking pin adapted to be disposed in the locking slot of the second hinge connector, the locking pin being selectively moveable within the locking slot between a locked position wherein the locking pin is positioned so that the cam portion of the first hinge connector abuts the locking pin so as to substantially prevent the first hinge connector from rotatable movement about the hinge axis, and an unlocked position wherein the first hinge connector is able to freely rotate about the hinge axis.

5. The folding picnic table recited in claim 4, further comprising a lock actuating mechanism pivotally disposed about the hinge pin, the lock actuating mechanism comprising:

a handle portion; and a displacement slot disposed at an offset angle with respect to the locking slot and configured to receive the locking pin so that when the handle is moved between a first position to a second position, the offset angle of the displacement slot acts to slide the locking pin in the locking slot between the locked and the unlocked position.

6. The folding picnic table as recited in claim 5, wherein the lock actuating mechanism further comprises:

a locking bar disposed in the second hinge connector; and an anchoring portion configured to maintain the handle in the first and second positions, the anchoring portion comprising an elongated member having a first groove and a second groove, wherein in the first position, the first groove is configured to engage a portion of the locking bar and in the second position, the second groove is configured to engage a portion of the locking bar.

7. The folding picnic table as recited in claim 1, wherein the first planar portion and the second planar portion comprise facing connecting apertures, each connecting aperture configured to receive one of the first end and the second end of the cross bar.

8. The folding picnic table as recited in claim 1, wherein the first leg member and the second leg member each comprise:

an inner portion;

an outer portion, wherein the inner portion and the outer portion slidably engage; and a locking mechanism for selectively positioning the inner portion and the outer portion at various lengths.

9. The folding picnic table as recited in claim 8, wherein the locking mechanism comprises:

a spring switch located on one of the inner portion and the outer portion; and a positioning hole located on the other of the inner portion and the outer portion, the positioning hole configured to receive the spring switch.

10. The folding picnic table as recited in claim 9, further comprising a depression lever for activating the spring switch.

11. The folding picnic table as recited in claim 1, further comprising:

a first pivotable support bar having a first end and a second end, the first end being connected to the first leg member and the second end being connected to the first planar portion; and a second pivotable support bar having a first end and a second end, the first end being connected to the second leg member and the second end being connected to the second planar portion.

12. The folding picnic table as recited in claim 1, wherein the table top supporting assembly comprising:

a second cross bar having a first end and a second end, the first end being connected to the first planar portion and the second end being connected to the second planar portion, wherein the second cross bar has a pivot connection disposed along the length thereof for allowing the second cross bar to fold;

a third leg member having a first end and a second end, the first end being connected to the second cross bar; and a fourth leg member having a first end and a second end, the first end being connected to the second cross bar.

13. The folding picnic table as recited in claim 12, further comprising:

a first side rail having a first end and a second end, the first end of the first side rail being connected to the first cross bar and the second end of the first side rail being connected to the second cross bar; and a second side rail having a first end and a second end, the first end of the second side rail being connected to the first cross bar and the second end of the second side rail being connected to the second cross bar.

14. The folding picnic table as recited in claim 1, further comprising a hinge assembly disposed between the first planar portion and the second planar portion.

15. The folding picnic table as recited in claim 1, wherein each of the first planar portion and the second planar portion comprise a handle formed thereon, the handles configured to align when the table top is folded to provide a carrying mechanism.

16. The folding picnic table as recited in claim 1, further comprising mortise and tenon members formed on the first and second planar portions.

* * * * *

UNITED STATES PATENT AND TRADEMARK OFFICE

CERTIFICATE OF CORRECTION

PATENT NO. : 6,905,166 B2
DATED : June 14, 2005
INVENTOR(S) : Zhurong et al.

It is certified that error appears in the above-identified patent and that said Letters Patent is hereby corrected as shown below:

Column 1,
Line 33, change “According,” to -- Accordingly, --.

Column 2,
Line 22, before “structures” change “legs” to -- leg --.

Column 3,
Line 31, before “pin hole” insert -- a --.
Line 42, change “included” to -- including --.

Column 5,
Line 32, change “limits” to -- limit --.
Line 41, change “picnic,” to -- picnic table, --.

Column 6,
Line 58, after “formed in” insert -- the --.

Column 8,
Line 11, after “connector” change “431” to -- 432 --.

Column 10,
Line 7, before “pin hole” insert -- a --.

Signed and Sealed this

Thirteenth Day of September, 2005

JON W. DUDAS
*Director of the United States Patent and Trademark Office*